United States Patent [19]

Masaka et al.

[11] Patent Number: 4,806,734

[45] Date of Patent: Feb. 21, 1989

[54] DIESEL ENGINE GLOW PLUG

[75] Inventors: Mitsuke Masaka; Koji Hatanaka, both of Higashimatsuyama, Japan

[73] Assignee: Jidosha Kiki Co., Ltd., Tokyo, Japan

[21] Appl. No.: 103,075

[22] Filed: Sep. 30, 1987

[30] Foreign Application Priority Data

Oct. 9, 1986 [JP] Japan ..... 61-154473[U]

[51] Int. Cl.[4] ..... F23Q 7/22; F02P 19/02; H05B 3/00

[52] U.S. Cl. ..... 219/270; 123/145 A; 219/553; 361/266

[58] Field of Search ..... 219/260–270, 219/544, 552, 553, 541; 123/145 R, 145 A; 361/264–266

[56] References Cited

U.S. PATENT DOCUMENTS

| | | | |
|---|---|---|---|
| 4,475,029 | 10/1984 | Yoshida et al. | 219/270 |
| 4,582,981 | 4/1986 | Brooks et al. | 219/541 X |
| 4,653,443 | 3/1987 | Fukazawa et al. | 219/270 X |

FOREIGN PATENT DOCUMENTS

| | | | |
|---|---|---|---|
| 58-62427 | 4/1983 | Japan | 219/270 |
| 59-52725 | 12/1984 | Japan . | |
| 60-17632 | 1/1985 | Japan . | |
| 60-14784 | 1/1985 | Japan . | |
| 60-9085 | 1/1985 | Japan . | |

*Primary Examiner*—Anthony Bartis
*Attorney, Agent, or Firm*—Townsend and Townsend

[57] ABSTRACT

A diesel engine glow plug includes a hollow holder, a ceramic heater, an electrically conductive annular member, an external connecting terminal, and an insulating sleeve. The annular member is interposed between the rear end portion of the ceramic heater and the distal end portion of the hollow holder. The external connecting terminal engages with the rear end portion of the ceramic heater from the rear end portion of the holder through an interior of the holder. The insulating sleeve is housed in the hollow holder to electrically insulate the external connecting terminal from the hollow holder. The ceramic heater includes a U-shaped heating portion and a pair of parallel lead portions extending backward from the heating portion and terminating in an enlarged diameter portion defining the rear end portion of the heater. One of the lead portions is electrically connected to the holder through the annular member. The remaining one of the lead portions is engaged with and electrically connected to the external connecting terminal. The rear end portion of the hollow holder fixes the above members housed in the holder. The annular member has a cylindrical portion, which surrounds the rear end portion of the heater, and a tapered portion which electrically connects the distal end portion of the holder with one of the lead portions.

9 Claims, 1 Drawing Sheet

DIESEL ENGINE GLOW PLUG

BACKGROUND OF THE INVENTION

The present invention relates to an improvement in a diesel engine glow plug having a ceramic heater made of a resistive ceramic material.

Generally, since a diesel engine has poor starting characteristics, a glow plug is disposed in a subcombustion chamber or a combustion chamber. In this case, a current is flowed through the glow plug so that the glow plug generates heat. Thus, the glow plug is used to increase an intake air temperature or used as an ignition source, thereby improving the starting characteristics of the engine.

In recent years, as a glow plug of this type, a ceramic heater type glow plug has received a great deal of attention since it is superior in heating characteristics and the like to a conventional sheath type glow plug. Conventional ceramic heaters are a heater obtained by embedding a metal heating wire in an insulating ceramic material as disclosed in Japanese patent laid-open (Kokai) no. 57-41523 and a heater obtained by forming a heating member made of a resistive ceramic material integrally with an insulating ceramic material as disclosed in Japanese patent laid-open (Kokai) Nos. 60-9085 and 60-14784.

In such a conventional ceramic heater type glow plug, the ceramic heater described above is generally bonded and fixed to the distal end portion of a holder as a glow plug main body by brazing or the like. One end of a metal conductive wire is connected to a heater rear end portion by welding or the like and the other end of the wire is connected to an external connecting terminal held at the holder rear end portion through an insulating bush and the like. Thus, the heater and the holder are assembled integrally with each other.

However, the above conventional ceramic heater type glow plug has three bonded portions, i.e., a brazed portion between the heater and the holder and welded portions at the both ends of the metal conductive wire, resulting in troublesome and cumbersome assembly and high cost. Moreover, peeling or the like of the brazed portion or the welded portion poses a problem. This problem is significant at the bonded portion between the heater made of a ceramic material and the holder made of a metal material. Thus, the above conventional glow plug poses a problem in assuring operational reliability. Therefore, demand has arisen for a countermeasure capable of solving the above problems.

SUMMARY OF THE INVENTION

It is, therefore, a principal object of the present invention to provide a highly reliable diesel engine glow plug which can be easily assembled at low cost.

In order to achieve the above object of the present invention, a diesel engine glow plug is provided which includes a hollow holder and a ceramic heater, a rear end portion of which is locked at a distal end portion of the hollow holder. An external electrical connection terminal engages the rear end portion of the ceramic heater from a rear end portion of the holder through the interior of the holder. An insulating sleeve, housed in the hollow holder, insulates the external connecting terminal from the hollow holder. The ceramic heater comprises a U-shaped heating portion and a pair of parallel lead portions extending backward from both ends of the heating portion, one of the lead portions being electrically connected to the holder, and the remaining one of the lead portions being engaged with and electrically connected to the external connecting terminal. The rear end portion of the hollow holder mechanically fixes the ceramic heater, the external connecting terminal, and the insulating sleeve, all of which are housed in the holder.

DESCRIPTION OF THE PREFERRED EMBODIMENT

An embodiment of the present invention will be described in detail with reference to the accompanying drawings.

Figure 1:
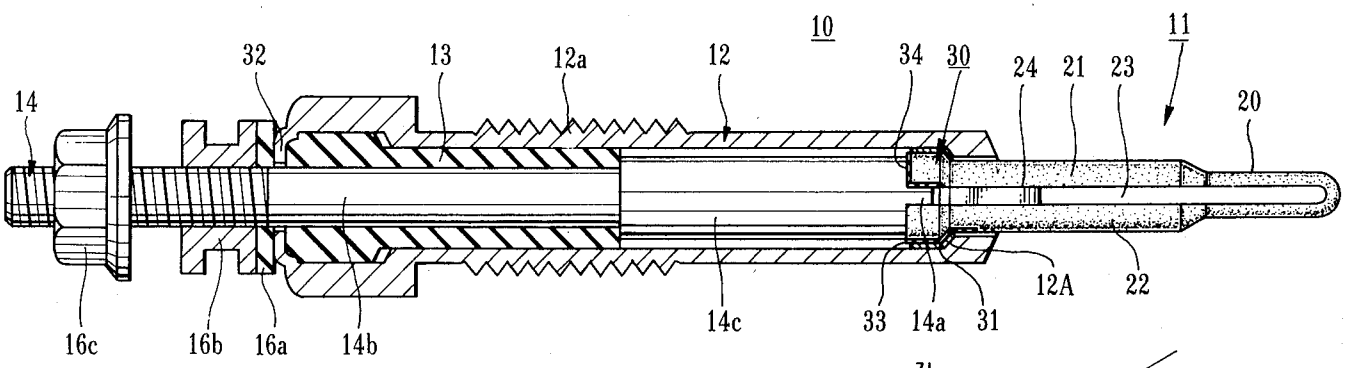
FIG. 1 is longitudinal sectional view of an embodiment of a diesel engine glow plug according to the present invention.
Figure 2:
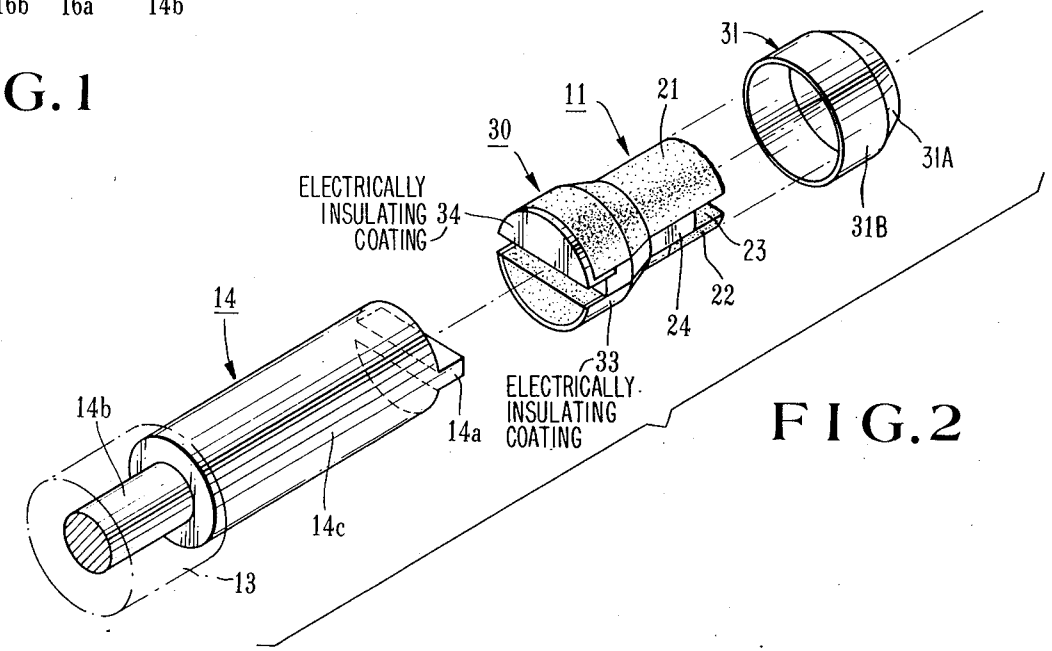
FIG. 2 is a exploded perspective view of the main part of FIG. 1.

FIGS. 1 and 2 show an embodiment of a diesel engine glow plug according to the present invention. A schematic arrangement of a glow plug denoted by reference numeral 10 in FIG. 1 will be briefly described below. The glow plug 10 comprises a rod-like ceramic heater 11 whose distal end portion serves as a heating portion and a substantially tubular metal holder 12 for holding the ceramic heater 11 at its distal end portion. An external connecting terminal 14 is concentrically fitted in the rear end portion of the holder 12 through an insulating sleeve 13 to be described later. An engaging piece **14*a* projecting from the distal end of the external connecting terminal 14 is engaged with one of lead portions (to be described later) made of a resistive ceramic material and constituting the ceramic heater 11, thereby connecting the external connecting terminal 14 therewith. Note that reference numerals 16*a*, 16*b*, and 16*c* denote an insulating ring, a fixing nut, and an external lead tightening nut, respectively, all of which are threadably engaged with a threaded portion at the rear end of the external connecting terminal 14. An outer surface threaded portion 12*a* of the holder 12 is threadably engaged with a screw hole of an engine cylinder head so that the holder 12 is electrically grounded and the distal end of the heater 11** projects in a subcombustion chamber or a combustion chamber.

According to this embodiment, the rod-like ceramic heater 11 held at the distal end of the holder 12 is obtained by integrally forming a U-shaped heating portion 20 and a pair of parallel lead portions 21 and 22 extending backward from both ends of the heating portion 20 and hence has a substantially U-shape as a whole, as shown in FIGS. 1 and 2. That is, the ceramic heater 11 has the heating portion 20 formed to have a small diameter so that its thickness or sectional area is smaller than that of the lead portions 21 and 22. A slit 23 extending along a longitudinal direction of the heater 11 is formed at a central portion thereof from the heating portion 20 to a portion between the lead portions 21 and 22. An insulating sheet 24 consisting of an insulating ceramic material is provided integrally with the heater 11 at a position in the slit 23 corresponding to the distal portion of the holder 12. The sheet 24 seals the interior of the holder 12 from the combustion chamber. In addition, the sheet 24 maintains a proper interval between the pair of lead portions 21 and 22 located at both sides of the slit 23 and mechanically couples the lead portions 21 and 22, thereby improving mechanical strength thereof. In this case, the insulating sheet 24 is located such that the distal end (engaging piece) 14*a* of the external connecting terminal 14 is fitted between the lead portions 21 and 22. Note that as a resistive ceramic material for forming the ceramic heater 11 and an insulating ceramic material, SiAlON or the like may be preferably used, which allows selection of an insulating property and resistivity by adjusting the amount of titanium nitride (TiN) added thereto. That is, by selecting such a material, the heater 11 and the insulating sheet 24 can be formed of the same material having substantially a predetermined thermal expansion coefficient, thereby increasing the bonding strength and assuring reliability such as heat resistance. However, the resistive and insulating ceramic materials are not limited to SiAlON but may be arbitrarily selected from other ceramic materials.

According to the ceramic heater 11 having the above arrangement, the heating portion 20 made of the resistive ceramic material is exposed on the surface of the heater 11. Therefore, the heater 11 can function as a fast heating ceramic heater. In addition, the heating portion 20 is formed of only the resistive ceramic material which does not contain an impurity. Accordingly, the ceramic heater 11 has high reliability on heat resistance, high durability, and the like in spite of a thermal stress repeatedly applied thereon during an operation.

According to the present invention, in the glow plug having the above arrangement, the distal end portion of the holder 12 is formed to have a diameter smaller than those of the other portions and has a shoulder 12A. A large-diameter portion 30 locked by the shoulder 12A is integrally formed with the rear end of the ceramic heater 11 formed of a resistive ceramic material. When the heater 11 is inserted from an opening formed in the rear end portion of the holder 12, the large-diameter portion 30 is locked inside the distal end portion of the holder 12 while a spacer 31 consisting of an electrically conductive plate member is interposed between a contact portion of the large-diameter portion 30 and the corresponding inner wall surface portion of the holder 12. In addition, the distal end portion of the terminal 14 inserted from the opening at the rear end portion of the holder 12 is engaged with the rear end portion of the heater 11. Therefore, the insulating sleeve 13 which holds the terminal 14 at the rear end portion of the holder 12 is locked and fixed by a caulked portion 32 provided at the periphery of the opening of the rear end portion of the holder 12 while being urged against the heater 11 thorugh the terminal 14. That is, according to the present invention, the ceramic heater 11, the terminal 14, and the insulating sleeve 13 are assembled in the holder 12 with the conductive spacer 31 interposed between the ceramic heater 11 and the holder 12, and the entire glow plug is integrally assembled by the caulked portion 32 formed by caulking the periphery of the opening of the rear end portion of the holder 12. According to the above arrangement, unlike the conventional glow plug, brazing or welding is not necessary, resulting in easy assembly. Moreover, it can be easily understood that a practical effect is great since required electrical connections are reliably assured.

More specifically, as is apparent from FIG. 2, the spacer 31 is formed of, e.g., a steel material or an aluminum material and consists of a tapered portion 31A which is brought into contact with a side surface of the large-diameter portion 30 and urged toward the heating portion 20 and a cylindrical portion 31B to be fitted on the outer surface of the large-diameter portion 30. Therefore, when the spacer 31 is assembled in and urged against the holder 12, the spacer 31 electrically connects the lead portion 21 of the heater 11 with the holder 12. In addition, the spacer 31 prevents application of excessive force on the heater 11 by its flexibility when the caulked portion is caulked, thereby preventing damage to the heater 11. In the ceramic heater 11 used in this embodiment, in order to electrically connect only the lead portion 21 at the rear end portion of the heater 11 with the spacer 31, an insulating coating layer 33 is formed on a contact portion of the lead portion 22. Note that a shape of the spacer 31 is not limited to that of this embodiment. For example, the spacer 31 may be formed to be a simple ring member and interposed between the side surface of the large-diameter portion 30 and the distal end portion of the holder 12. That is, a variety of modifications of the spacer 31 may be made.

The external connecting terminal 14 is constituted by a small-diameter portion 14*b* on which the insulating sleeve 13 is fitted, a large-diameter portion 14*c* at the distal end portion of the small-diameter portion 14*b*, and the distal end engaging piece 14*a* which is engaged with the slit 23 formed between the pair of lead portions 21 and 22 at the rear end portion of the ceramic heater 11 to electrically connect them. It is a matter of course that an insulating coating layer 34 is similarly formed at the portion of the rear end portion of the lead portion 21 of heater 11 with which the engaging piece 14*a* and the large-diameter portion 14*c* are engaged.

The insulating sleeve 13 is formed of an insulating material such as alumina. The outer end of the insulating sleeve 13 is held by the large-diameter portion of the rear end portion of the holder 12, and the distal end portion thereof is engaged with the large-diameter portion 14c of the external connecting terminal 14 through a space inside the holder 12, thereby locking the external connecting terminal 14. Therefore, when the insulating sleeve 13 is locked by the caulked portion 32 at the rear end portion of the holder 12, the external connecting terminal 14 and hence the heater 11 are locked at the distal end portion of the holder 12 while urging the spacer 31. Thus, assembly of the entire glow plug 10 is completed.

According to the present invention having the above arrangement, the glow plug 10 can be easily and reliably assembled by simply assembly and caulking with respect to the periphery of the opening at the rear end portion of the holder, thereby omitting conventional brazing or welding. In addition, since the ceramic heater 11 and the holder 12 are reliably electrically conducted through the spacer 31, the glow plug of the present invention has reliability better than that of a conventional one.

Note that the present invention is not limited to the structure of the above embodiment. For example, shapes or structures of the respective parts can be arbitrarily changed or modified. In addition, an engaging structure between the external connecting terminal 14 and the insulating sleeve 13 is not limited to the engaging structure with respect to the large-diameter portion as in the above embodiment but can be variously modified.

According to the present invention as has been described above, the glow plug comprises a rod-like ceramic heater formed of a resistive ceramic material and having a large-diameter portion to be locked at the distal end portion of a holder, an external connecting terminal, inserted from the rear end portion of the holder, the distal end of which is engaged with the rear end portion of the heater, and an insulating sleeve for holding the external connecting terminal at the rear end portion of the holder. A large-diameter portion at the rear end of the heater is connected to the distal end portion of the holder through a spacer formed of an electrically conductive plate member and is fixed by locking the insulating sleeve by a caulked portion at a periphery of an opening of the rear end portion of the holder while urging the external connecting terminal toward the heater. Therefore, unlike a conventional glow plug, cumbersome operations such as brazing and welding are not necessary in spite of a simple arrangement in the holder, and the rear end of the holder can be fixed by only caulking, thereby completing assembly. As a result, workability during assembly is largely improved and cost is reduced, thereby achieving a variety of practical effects.

What is claimed is:

1. A diesel engine glow plug comprising:

an electrically conductive hollow holder;

an elongated ceramic heater, a rear end portion of which is mechanically fixed at a distal end portion of said hollow holder;

an electrically conductive annular member interposed between said rear end portion of said ceramic heater and said distal end portion of said hollow holder to provide mechanical and electrical connections therebetween;

an external electrical connection terminal engaging with the rear end portion of said ceramic heater from a rear end portion of said holder through an interior of said holder; and an electrically insulating sleeve, housed in said hollow holder, electrically insulating said external electrical connection terminal from said hollow holder, said ceramic heater comprising an exposed foward U-shaped heating portion and a pair of parallel lead portions extending backward from both ends of said heating portion and terminating in an enlarged diameter portion defining said rear end portion of said heater, one of said lead portions being electrically connected to said holder through said annular member but insulated from said external electrical connection terminal by an insulating member, the remaining one of said lead portions being engaged with and electrically connected to said external electrical connection terminal but electrically insulated from said annular member and said holder, and the rear end portion of said hollow holder being provided with a fixing structure mechanically fixing said ceramic heater, said external connecting terminal, and said insulating sleeve, all of which are housed in said holder, said annular member comprising a cylindrical portion surrounding said rear end portion of said heater and a tapered portion electrically connecting said distal end portion of said holder with said one of said lead portions.

2. A plug according to claim 1, wherein said external electrical connection terminal engages with said one of said lead portions through an electrically insulating member.

3. A plug according to claim 1, wherein an electrically insulating member is further arranged between said lead portions.

4. A plug according to claim 1, wherein the distal end portion of said holder locks said enlarged large-diameter rear end portion of said ceramic heater.

5. A plug according to claim 1, wherein said ceramic heater is formed of a resistive ceramic member, and said remaining one of lead portions is engaged with said holder through an electrically insulating member.

6. A plug according to claim 1, wherein said ceramic heater is formed of a resistive ceramic member, and an insulating layer is formed between said remaining one of said lead portions and said electrically conductive annular member.

7. A plug according to claim 1, wherein an electrically insulating ceramic member is arranged between said lead portions.

8. A plug according to claim 1, wherein a sectional area of said heating portion is smaller than that of said lead portions.

9. A plug according to claim 1, wherein said fixing structure at the distal end portion of said holder is a caulked structure.

* * * * *